US010796634B2

(12) United States Patent
Zhang

(10) Patent No.: US 10,796,634 B2
(45) Date of Patent: Oct. 6, 2020

(54) DISPLAY CONTROL CIRCUIT, METHOD AND PANEL DISPLAY DEVICE

(71) Applicant: Shenzhen China Star Optoelectronics Semiconductor Display Technology Co., Ltd., Shenzhen (CN)

(72) Inventor: Xianming Zhang, Shenzhen (CN)

(73) Assignee: SHENZHEN CHINA STAR OPTOELECTRONICS SEMICONDUCTOR DISPLAY TECHNOLOGY CO. , LTD., Shenzhen, Guangdong (CN)

( * ) Notice: Subject to any disclaimer, the term of this patent is extended or adjusted under 35 U.S.C. 154(b) by 0 days.

(21) Appl. No.: 16/311,679

(22) PCT Filed: Oct. 16, 2018

(86) PCT No.: PCT/CN2018/110548

§ 371 (c)(1),
(2) Date: Dec. 20, 2018

(87) PCT Pub. No.: WO2020/024433

PCT Pub. Date: Feb. 6, 2020

(65) Prior Publication Data

US 2020/0035149 A1 Jan. 30, 2020

(30) Foreign Application Priority Data

Jul. 30, 2018 (CN) ..... 2018 1 0854444

(51) Int. Cl.
*G09G 3/3208* (2016.01)
*G09G 3/36* (2006.01)

(52) U.S. Cl.
CPC ..... *G09G 3/3208* (2013.01); *G09G 3/36* (2013.01); *G09G 2320/0673* (2013.01); *G09G 2330/00* (2013.01)

(58) Field of Classification Search
CPC ..... G09G 3/3208; G09G 3/36; G09G 2320/0673; G09G 2330/00; G09G 3/3696;
(Continued)

(56) References Cited

U.S. PATENT DOCUMENTS 8,199,091 B2 * 6/2012 Ker ..... G09G 3/3696 345/204
9,280,927 B2 * 3/2016 Kishikawa ..... G09G 3/20
(Continued)

FOREIGN PATENT DOCUMENTS

CN 1722213 A 1/2006
CN 103943088 A 7/2014
(Continued)

*Primary Examiner* — Grant Sitta
(74) *Attorney, Agent, or Firm* — Leong C. Lei

(57) ABSTRACT

The invention provides a display control circuit, method and panel display device. The display control circuit includes: a current source, a first capacitor, a discharge circuit, a subtractor, and an initial reference voltage generating module; the current source coupled to first end of the first capacitor to generate a charging voltage changing with time, and second end of the first capacitor grounded; the discharge circuit connected to first end of the first capacitor to clear the charging voltage at beginning of each frame; a negative input end of the subtractor inputting the charging voltage, a positive input end of the subtractor connected to output end of the initial reference voltage generating module, and the subtractor outputting an adjusted reference voltage required for different regions of display panel; the initial reference voltage generating module outputting a fixed initial reference voltage; the adjusted reference voltage used for generating a gamma voltage.

12 Claims, 2 Drawing Sheets

(58) Field of Classification Search
CPC ..... G09G 2320/0223; G09G 2330/02; G09G 2330/028
See application file for complete search history.

(56) References Cited

U.S. PATENT DOCUMENTS

| | | | | |
|---|---|---|---|---|
| 9,377,907 | B2 * | 6/2016 | Shahparnia | G06F 3/0418 |
| 9,747,861 | B2 * | 8/2017 | Nam | G09G 3/3208 |
| 2004/0183587 | A1 * | 9/2004 | Yamahira | G05F 3/262 327/540 |
| 2008/0165165 | A1 * | 7/2008 | Wang | G09G 3/3275 345/204 |
| 2010/0033514 | A1 * | 2/2010 | Park | G09G 3/3291 345/690 |
| 2010/0321370 | A1 | 12/2010 | Weng | |
| 2012/0056863 | A1 * | 3/2012 | Watanabe | H03K 3/0231 345/211 |
| 2012/0146720 | A1 * | 6/2012 | Hsu | H03F 3/45076 330/69 |
| 2013/0187624 | A1 * | 7/2013 | Wakasugi | H02M 3/158 323/282 |
| 2014/0225942 | A1 * | 8/2014 | Liu | G09G 3/36 345/694 |
| 2015/0244267 | A1 * | 8/2015 | Park | G09G 3/3233 345/76 |
| 2016/0104405 | A1 * | 4/2016 | Fang | G09G 3/20 345/204 |
| 2017/0032742 | A1 * | 2/2017 | Piper | G09G 3/3233 |
| 2017/0032758 | A1 * | 2/2017 | Park | G09G 3/2003 |

FOREIGN PATENT DOCUMENTS

| | | | |
|---|---|---|---|
| CN | 104732949 | A | 6/2015 |
| CN | 107317476 | A | 11/2017 |
| KR | 20060086170 | A | 7/2006 |

* cited by examiner

DISPLAY CONTROL CIRCUIT, METHOD AND PANEL DISPLAY DEVICE

BACKGROUND OF THE INVENTION

1. Field of the Invention

The present invention relates to the field of display, and in particular to a display control circuit, method and panel display device.

2. The Related Arts

The panel display device is widely used due to thinness and low power consumption, and the conventional panel display device generally includes a liquid crystal display (LCD) and an organic light-emitting diode display (OLED). With the development of technology and the needs of consumers, the size of contemporary panel display devices is getting bigger and bigger.

For the current panel display devices, the size is getting larger and larger, and the RC delay of the display panel is also increasing, which is easy to cause the charged voltage inequality on the near and far sides of the chip-on-film (COF), resulting in the display panel being bright near the chip and being dark away from the chip, causing a large display difference and affecting the display effect.

The driving system of the existing panel display device usually includes a programmable gamma circuit (P-Gamma IC). Using the input reference voltage Vref, the P-gamma IC can be programmed to generate a gamma voltage, which can be supplied to the data driving circuit to perform gamma correction on the pixel grayscale reference voltage generated by the data driving circuit to obtain the pixel grayscale voltage.

In the prior art, the reference voltage Vref is used as a reference voltage of gamma voltage of all areas such as the far end, the middle area, and the near end of the display panel, and after inputting a to the P-Gamma IC, all the gamma voltages are thus generated in a voltage division manner (first analog-to-digital conversion (ADC) and then digital-to-analog conversion (DAC) output). In the case where the reference voltage Vref is constant, if the gamma voltage is to be adjusted to improve the unequal charged voltages of the near-COF side and the far-COF side, the only way is to use the gamma code method, but this method is difficult to achieve during one frame time of the panel display device.

SUMMARY OF THE INVENTION

The object of the present invention is to provide a display control circuit, able to achieve different adjustments of the display panel gamma voltages at the near and far ends in the same frame.

Another object of the present invention is to provide a panel display device, able to achieve different adjustments of the display panel gamma voltages at the near and far ends in the same frame.

Yet another object of the present invention is to provide a display control method, able to achieve different adjustments of the display panel gamma voltages at the near and far ends in the same frame.

To achieve the above object, the present invention provides a display control circuit, comprising: a current source, a first capacitor, a discharge circuit, a subtractor, and an initial reference voltage generating module; the current source being coupled to a first end of the first capacitor to generate a charging voltage changing with time, and a second end of the first capacitor being grounded; the discharge circuit being connected to the first end of the first capacitor to clear the charging voltage at beginning of each frame of display panel; a negative input end of the subtractor being connected to the first end of the first capacitor to input the charging voltage, a positive input end of the subtractor being connected to an output end of the initial reference voltage generating module, and an output end of the subtractor outputting an adjusted reference voltage required for different regions of the display panel; an output of the initial reference voltage generating module outputting a fixed initial reference voltage; the adjusted reference voltage being for generating a gamma voltage.

Wherein, the discharge circuit is an NMOS transistor, with a source grounded, a drain connected to the first end of the first capacitor, and a gate connected to a control signal; the control signal turns on the NMOS transistor at the beginning of each frame of the display panel, clears the charging voltage and the turns off the NMOS transistor.

Wherein, the display control circuit is disposed outside of a programmable gamma circuit (P-Gamma IC), and the adjusted reference voltage is inputted to a reference voltage input end of the P-Gamma IC.

Wherein, the change curve of the charging voltage in a frame time of the display panel is obtained by approximating the change curve of the adjusted reference voltage required by far end, middle region and near end of the display panel, and the adjusted reference voltages required by three foregoing locations are derived from the gamma voltages required for the three locations.

Wherein, the current source and the first capacitor are preset according to the change curve.

Wherein, the initial reference voltage generating module comprises a controllable precision voltage stabilizing source; a first resistor is connected between a reference end and a cathode of the controllable precision voltage stabilizing source, a second resistor and a third resistor are connected in series between the reference end and an anode, the cathode is connected to an input voltage via a fourth resistor, the cathode outputs an initial reference voltage via a fifth resistor, and the anode is grounded.

The present invention also provides a panel display device comprising the display control circuit of any of the above.

Wherein, the panel display device is a TFT-LCD panel display device or an OLED panel display device.

The present invention also provides a display control method, comprising the following steps:

the current source being coupled to the first end of the first capacitor to generate a charging voltage changing with time, and the second end of the first capacitor being grounded;

the discharge circuit being coupled to the first end of the first capacitor to clear the charging voltage at beginning of each frame of the display panel;

the negative input end of the subtractor being connected to the first end of the first capacitor to input the charging voltage, the positive input end of the subtractor being connected to the output end of the initial reference voltage generating module, and the output end of the subtractor outputting different adjusted reference voltages required by different areas of the display panel;

the output end of the initial reference voltage generating module outputting a fixed initial reference voltage;

the adjusted reference voltage being used for generating a gamma voltage.

Wherein, the change curve of the charging voltage in a frame time of the display panel is obtained in advance by approximating the change curve of the adjusted reference voltage required by far end, middle region and near end of the display panel, and the adjusted reference voltages required by three foregoing locations are derived from the gamma voltages required for the three locations.

In summary, the display control circuit, method and panel display device of the present invention realize different gamma voltage adjustments for the gamma voltages of the display panel in the same frame at the far and near ends, thereby realizing the improvement of the display quality of the entire display panel without causing other risk.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technical means and effect of the present invention, the following refers to embodiments and drawings for detailed description.

Figure 1:
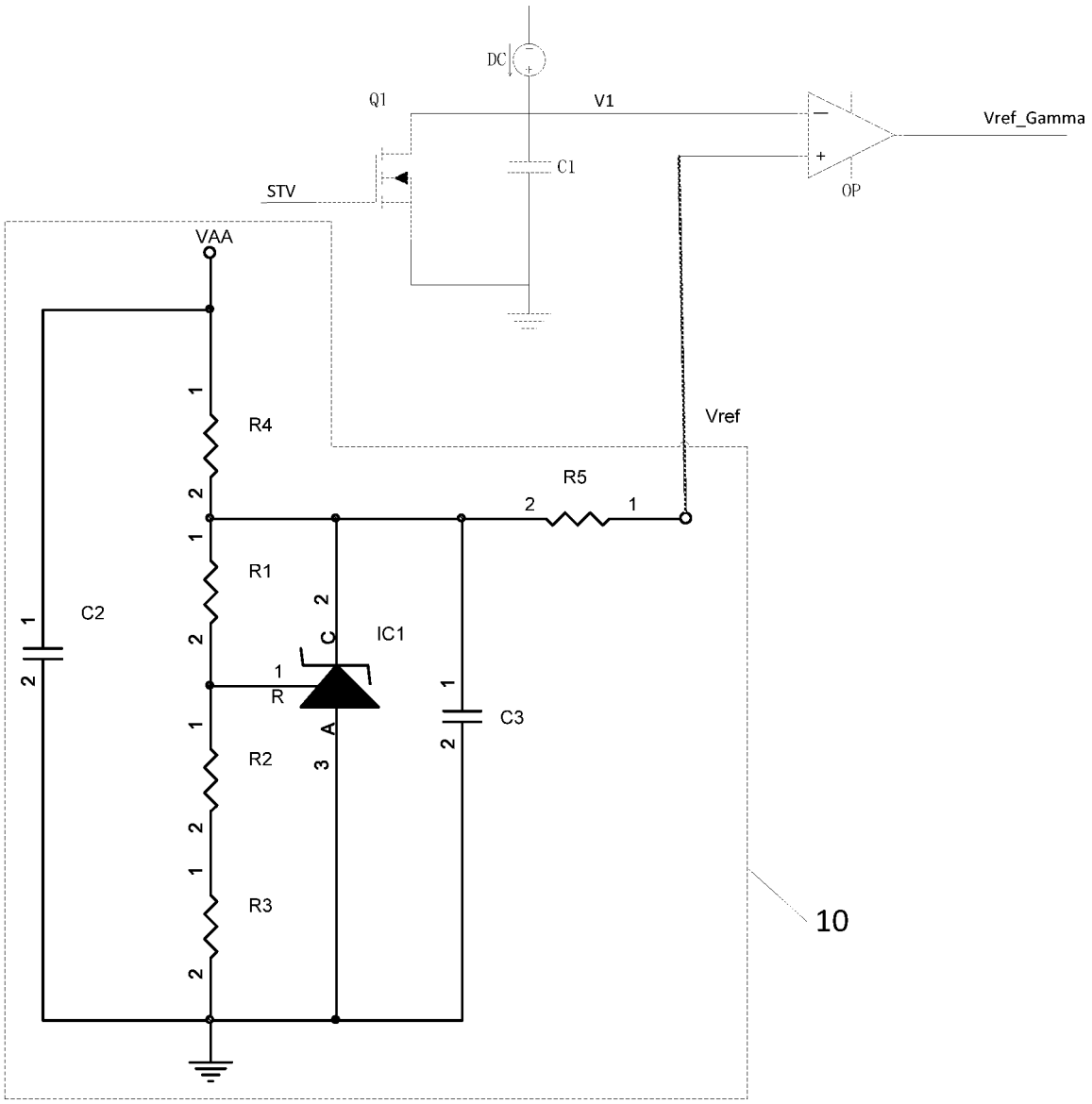
FIG. 1 is a schematic view showing a display control circuit of a preferred embodiment of the present invention.

Refer to FIG. 1. FIG. 1 is a schematic view showing a display control circuit of a preferred embodiment of the present invention. The display control circuit comprises: a direct current source DC, a first capacitor C1, a discharge circuit, a subtractor OP, and an initial reference voltage generating module 10. The initial reference voltage generating module 10 mainly comprises a controllable precision voltage stabilizing source IC1, and the controllable precision voltage stabilizing source is implemented with a chip TL431. A first resistor R1 is connected between the reference terminal R and the cathode C of the controllable precision voltage stabilizing source TL431, a second resistor R2+ and a third resistor R3 are connected in series between the reference terminal R and the anode A. The cathode C is connected to the input voltage VAA via a fourth resistor R4, the cathode C outputs an initial reference voltage Vref via a fifth resistor R5, and the anode A is grounded. In the present embodiment, the resistance value of R5 may be specifically 0, Vref=2.5×[1+R1/(R2+R3)], and by setting the resistance values of R1, R2 and R3, Vref can be controlled to be specifically 16.47V. The input voltage VAA can be specifically 16.8V, and the resistor R4 is used for current limiting. By setting the resistance value of R4, the current control flowing through R4 can be limited to 9.9 mA. A second capacitor C2 is connected to the input voltage VAA at one end, and the other end is grounded; a third capacitor C3 is connected to the cathode C of the controllable precision voltage stabilization source IC1 at one end, and the other end is grounded; the second capacitor C2 and the third capacitor C3 can respectively perform filtering on the input voltage VAA and the initial reference voltage Vref. The output end of the initial reference voltage generating module 10 outputs a fixed initial reference voltage Vref. The initial reference voltage Vref is mainly generated by the input voltage VAA through the voltage division of the controllable precision voltage stabilizing source, and is unchanged after being generated. The output of a specific initial reference voltage Vref can be realized by setting specific parameters of each component in the initial reference voltage generating module 10.

In this embodiment, the discharge circuit is an enhanced NMOS transistor Q1, with a source grounded, a drain connected to the first end of the first capacitor C1, and a gate connected to the control signal STV. The control signal STV is used for turning on the NMOS transistor Q1, clearing the charging voltage V1 on the first capacitor C1 and then turning off the NMOS transistor Q1 when each frame starts on the display panel. For example, the control signal STV can be high at the beginning of each frame, and turns to low after clearing the charging voltage V1. Turning on and off the NMOS transistor Q1 can control whether to clear the charging voltage V1.

The direct current source DC is connected to the first end of the first capacitor C1 to generate a charging voltage V1 that changes with time. The second end of the first capacitor C1 is grounded. The first end of the first capacitor C1 is connected to the negative input end of the subtractor OP for inputting the charging voltage V1, the positive input end of the subtractor OP inputs the initial reference voltage Vref, and the output end of the subtractor OP outputs the adjusted reference voltage Vref_Gamma. The adjusted reference voltage Vref_Gamma can be inputted to the P-Gamma IC (not shown) for further generation of a corresponding adjusted gamma voltage by the P-Gamma IC.

In this embodiment, the subtractor OP is set such that the adjusted reference voltage Vref_Gamma is equal to the initial reference voltage Vref subtracted by the charging voltage V1, that is, the adjusted reference voltage Vref_Gamma=the initial reference voltage Vref−the charging voltage V1. Since the charging voltage V1 changes continuously within one frame time as the charging process proceeds, the adjusted reference voltage Vref_Gamma also changes continuously. Specifically, as the charging time becomes longer, the charging voltage V1 gradually becomes larger, and the corresponding adjusted reference voltage Vref_Gamma becomes smaller and smaller. The gamma voltage obtained after the adjusted reference voltage Vref_Gamma inputted to the P-Gamma IC is also gradually reduced; that is, the gamma voltage supplied to the display panel by the P-Gamma IC is also gradually reduced. Since the charging voltage V1 is cleared at the beginning of each frame of the display panel, the adjusted reference voltage Vref_Gamma outputted by the display control circuit of the present invention is at most equal to the initial reference voltage Vref, and correspondingly, the gamma voltage supplied by the P-Gamma IC to the display panel data driving circuit is also the largest, and the data driving circuit correspondingly drives the far end of the display panel. The charging voltage V1 reaches the maximum at the end of each frame of the display panel. the adjusted reference voltage Vref_Gamma outputted by the display control circuit of the present invention is the smallest. Correspondingly, the gamma voltage of the P-Gamma IC supplied to the display panel data driving circuit is also minimum. At this point, the data driving circuit corresponds to driving the near end of the display panel. That is, by the display control circuit of the present invention, the gamma voltage of the display panel from the far end to the near end of the display panel is gradually reduced, so that the problem that the existing display panel is bright at the near end and dark at the far end can be solved.

In this embodiment, the specific value of the fixed initial reference voltage Vref outputted by the initial reference voltage generating module 10 can be determined according to the required gamma voltage at the far end of the display panel. This is because when the same gamma voltage is supplied to the display panel, the display panel is bright at the near end and dark at the far end. To achieve a more uniform display effect, that is, the brightness of the display panel from the far end to the near end is substantially the same, the adjusted reference voltage Vref_Gamma required by the far end must be relatively larger than by the near end. In this embodiment, the adjusted reference voltage Vref_Gamma required for the far end of the display panel is set equal to the fixed initial reference voltage Vref outputted by the initial reference voltage generating module 10, and the adjusted reference voltage Vref_Gamma required for other areas of the display panel (such as, the middle region and the near end) is obtained by subtracting the gradually increasing charging voltage V1 from the fixed initial reference voltage Vref.

The change curve of the charging voltage V1 in the frame time of the display panel can be pre-fitted according to the changing trend of the adjusted reference voltage in different regions of the display panel. The adjusted reference voltage of different regions can be adjusted from the far end to the near end according to the gamma voltage required in different regions of the display panel. For example, the change curve of the charging voltage V1 in the frame time of the display panel may be pre-selected according to the change trend of the adjusted reference voltage at three locations, such as, the far end, the middle region, and the near end of the display panel. The data of the three locations are fitted, and the adjusted reference voltages of the three locations can be converted in advance based on the required gamma voltages of the three locations. Further, it is also possible to select more locations than the three locations of the far end, the middle region, and the near end on the display panel for fitting. Both the direct current source DC and the first capacitor C1 can be preset according to a pre-fitted curve, that is, a suitable direct current source DC and a first capacitor C1 are selected to bring the actual charging process closer to the previously obtained curve.

Figure 2:
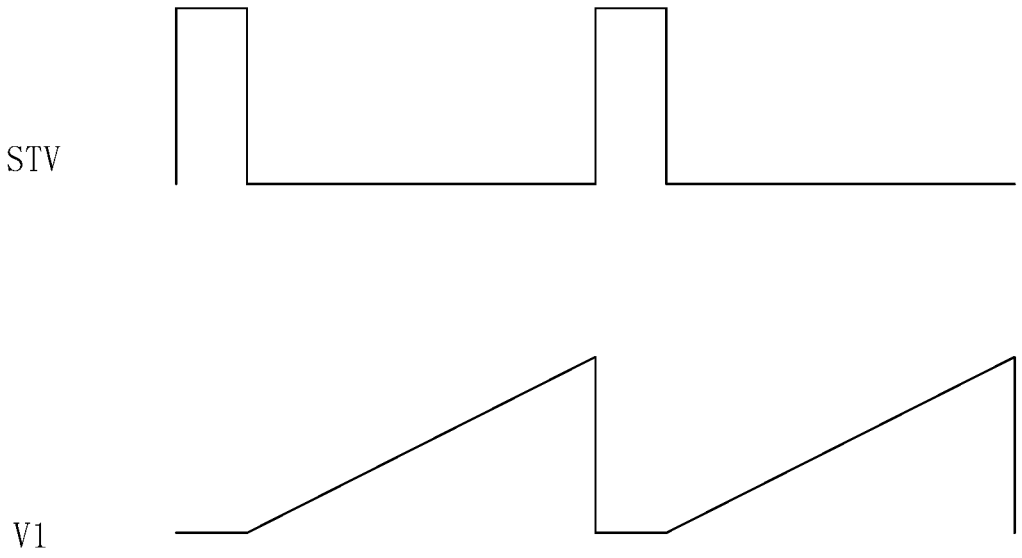
FIG. 2 is a schematic view showing the relation between the charging voltage V1 and control signal STV in the display control circuit of a preferred embodiment of the present invention.

FIG. 2 is a schematic view showing the relation between the charging voltage V1 and the control signal STV according to a preferred embodiment of the display control circuit of the present invention. The control signal STV is at a high level at the beginning of each frame of the display panel. After the charging voltage V1 is cleared, the control signal STV is turned to a low level, and the charging process starts. The direct current source DC is set to output a constant current charging current I, and then the charging voltage V1 on the first capacitor C1=the charging current I×the charging time t/the first capacitor C1. The display control circuit of the present invention can be disposed outside of the existing P-Gamma IC and the adjusted reference voltage Vref_Gamma is inputted to the reference voltage input end of the existing P-Gamma IC. Then, the gamma voltage is generated by using the adjusted reference voltage Vref_Gamma.

The present invention compensates for the problem that the voltages charged on the near-COF side and the far-COF side are not equal due to the delay of the resistance and capacitance by adjusting the gamma voltage. Specifically, according to the magnitude of the required gamma voltage at the three locations (far end, middle region, and near end), the amount of change of the reference voltage can be obtained, and the gamma voltage required for different regions can be changed by the change of the reference voltage of different regions. The voltage makes the display uniform over the entire display panel.

Based on the above display control circuit, the present invention also provides a corresponding panel display device comprising the above display control circuit. The panel display device of the present invention may be a TFT-LCD panel display device or an OLED panel display device.

The present invention also provides a corresponding display control method, which can be implemented based on the above display control circuit and the panel display device, and mainly comprises the following steps:

the direct current source DC is connected to the first end of the first capacitor C1 to generate a charging voltage V1 that changes with time, and the second end of the first capacitor C1 is grounded;

the discharge circuit is connected to the first end of the first capacitor C1 to clear the charging voltage V1 at the beginning of each frame of the display panel;

the negative input end of the subtractor OP is connected to the first end of the first capacitor C1 to input the charging voltage V1, the positive input end of the subtractor is connected to the output end of the initial reference voltage generating module 10, and the output end of the subtractor outputs the adjusted reference voltage Vref_Gamma required for different areas of the display panel;

the output end of the initial reference voltage generating module 10 outputs a fixed initial reference voltage Vref;

the adjusted reference voltage Vref_Gamma is used to generate a gamma voltage.

The present invention uses the reference voltage generating module 10 to generate a fixed initial reference voltage Vref. The initial reference voltage Vref can be obtained according to the maximum gamma voltage required at the far end of the display panel; the direct current source DC charges the first capacitor C1 to form a charging voltage V1 changing with time, and the charging voltage V1 is cleared by the control signal STV when the display panel is turned on every frame. The initial reference voltage Vref is subtracted from the charging voltage V1 to obtain the adjusted reference voltage Vref_Gamma required for different regions. The adjusted reference voltage Vref_Gamma is used as the reference voltage input to the reference voltage input end of the P-Gamma IC, that is, the different gamma voltage adjustments of the gamma voltage at the far end and the near end can be realized.

Wherein, the change curve of the charging voltage V1 that changes with time in a frame time of the display panel can be pre-fitted according to the trend of the adjusted reference voltage in different regions. The adjusted reference voltage in different regions of the display panel can be obtained from the required gamma voltage in different regions from the far end to the near end; by selecting the appropriate current source DC and the first capacitor C1, the change of the charging voltage V1 can be made to conform to the curve obtained by the pre-fitting.

In summary, the display control circuit, method and panel display device of the present invention realize different gamma voltage adjustments for the gamma voltages of the display panel in the same frame at the far and near ends, thereby realizing the improvement of the display quality of the entire display panel without causing other risk.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A display control circuit, comprising: a current source, a first capacitor, a discharge circuit, a subtractor, and an initial reference voltage generating module; the current source being coupled to a first end of the first capacitor to generate a charging voltage changing with time, and a second end of the first capacitor being grounded; the discharge circuit being connected to the first end of the first capacitor to clear the charging voltage at beginning of each frame of display panel; a negative input end of the subtractor being connected to the first end of the first capacitor to input the charging voltage, a positive input end of the subtractor being connected to an output end of the initial reference voltage generating module, and an output end of the subtractor outputting an adjusted reference voltage required for different regions of the display panel; an output of the initial reference voltage generating module outputting a fixed initial reference voltage; the adjusted reference voltage being for generating a gamma voltage, wherein the change curve of the charging voltage in a frame time of the display panel is obtained by approximating the change curve of the adjusted reference voltage required by far end, middle region and near end of the display panel, and the adjusted reference voltages required by three foregoing locations are derived from the gamma voltages required for the three locations.

2. The display control circuit as claimed in claim 1, wherein the discharge circuit is an NMOS transistor, with a source grounded, a drain connected to the first end of the first capacitor, and a gate connected to a control signal; the control signal turns on the NMOS transistor at the beginning of each frame of the display panel, clears the charging voltage and the turns off the NMOS transistor.

3. The display control circuit as claimed in claim 1, wherein the display control circuit is disposed outside of a programmable gamma circuit (P-Gamma IC), and the adjusted reference voltage is inputted to a reference voltage input end of the P-Gamma IC.

4. The display control circuit as claimed in claim 1, wherein the current source and the first capacitor are preset according to the change curve.

5. The display control circuit as claimed in claim 1, wherein the initial reference voltage generating module comprises a controllable precision voltage stabilizing source; a first resistor is connected between a reference end and a cathode of the controllable precision voltage stabilizing source, a second resistor and a third resistor are connected in series between the reference end and an anode, the cathode is connected to an input voltage via a fourth resistor, the cathode outputs an initial reference voltage via a fifth resistor, and the anode is grounded.

6. A panel display device, comprising a display control circuit, the display control circuit further comprising: a current source, a first capacitor, a discharge circuit, a subtractor, and an initial reference voltage generating module; the current source being coupled to a first end of the first capacitor to generate a charging voltage changing with time, and a second end of the first capacitor being grounded; the discharge circuit being connected to the first end of the first capacitor to clear the charging voltage at beginning of each frame of display panel; a negative input end of the subtractor being connected to the first end of the first capacitor to input the charging voltage, a positive input end of the subtractor being connected to an output end of the initial reference voltage generating module, and an output end of the subtractor outputting an adjusted reference voltage required for different regions of the display panel; an output of the initial reference voltage generating module outputting a fixed initial reference voltage; the adjusted reference voltage being for generating a gamma voltage.

7. The panel display device as claimed in claim 6, wherein the discharge circuit is an NMOS transistor, with a source grounded, a drain connected to the first end of the first capacitor, and a gate connected to a control signal; the control signal turns on the NMOS transistor at the beginning of each frame of the display panel, clears the charging voltage and the turns off the NMOS transistor.

8. The panel display device as claimed in claim 6, wherein the display control circuit is disposed outside of a programmable gamma circuit (P-Gamma IC), and the adjusted reference voltage is inputted to a reference voltage input end of the P-Gamma IC.

9. The panel display device as claimed in claim 6, wherein the change curve of the charging voltage in a frame time of the display panel is obtained by approximating the change curve of the adjusted reference voltage required by far end, middle region and near end of the display panel, and the adjusted reference voltages required by three foregoing locations are derived from the gamma voltages required for the three locations.

10. The panel display device as claimed in claim 9, wherein the current source and the first capacitor are preset according to the change curve.

11. The panel display device as claimed in claim 6, wherein the initial reference voltage generating module comprises a controllable precision voltage stabilizing source; a first resistor is connected between a reference end and a cathode of the controllable precision voltage stabilizing source, a second resistor and a third resistor are connected in series between the reference end and an anode, the cathode is connected to an input voltage via a fourth resistor, the cathode outputs an initial reference voltage via a fifth resistor, and the anode is grounded.

12. A display control method, comprising:

the current source being coupled to the first end of the first capacitor to generate a charging voltage changing with time, and the second end of the first capacitor being grounded;

the discharge circuit being coupled to the first end of the first capacitor to clear the charging voltage at beginning of each frame of the display panel;

the negative input end of the subtractor being connected to the first end of the first capacitor to input the charging voltage, the positive input end of the subtractor being connected to the output end of the initial reference voltage generating module, and the output end of the subtractor outputting different adjusted reference voltages required by different areas of the display panel;

the output end of the initial reference voltage generating module outputting a fixed initial reference voltage;

the adjusted reference voltage being used for generating a gamma voltage;

wherein the change curve of the charging voltage in a frame time of the display panel is obtained in advance by approximating the change curve of the adjusted reference voltage required by far end, middle region and near end of the display panel, and the adjusted reference voltages required by three foregoing locations are derived from the gamma voltages required for the three locations.

* * * * *